US007735914B2

(12) United States Patent
Longnecker

(10) Patent No.: US 7,735,914 B2
(45) Date of Patent: Jun. 15, 2010

(54) OTTOMAN RECLINER

(75) Inventor: Cabot Longnecker, Knoxville, TN (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/895,171

(22) Filed: Jul. 20, 2004

(65) Prior Publication Data

US 2005/0023869 A1 Feb. 3, 2005

Related U.S. Application Data

(60) Provisional application No. 60/490,817, filed on Jul. 29, 2003.

(51) Int. Cl.
*A47C 1/035* (2006.01)

(52) U.S. Cl. ..... 297/125; 297/85 R; 297/378.1; 297/423.41

(58) Field of Classification Search ..... 297/83–85, 297/125, 378.1, 378.12, 423.41
See application file for complete search history.

(56) References Cited

U.S. PATENT DOCUMENTS 1,703,969 A * 3/1929 Syvrud ..... 16/357
2,042,886 A * 6/1936 Ferguson ..... 16/361
2,716,775 A * 9/1955 Kenimer ..... 16/357
2,925,852 A * 2/1960 Lorenz ..... 297/85
4,394,047 A * 7/1983 Brunelle ..... 297/362.12
5,015,026 A * 5/1991 Mouri ..... 296/65.17
5,104,182 A * 4/1992 Rasnick et al. ..... 297/113
5,374,101 A * 12/1994 Wiecek ..... 297/85
5,531,506 A * 7/1996 Scott ..... 297/463.1
5,810,431 A * 9/1998 Gibson ..... 297/85
5,842,743 A * 12/1998 Wright et al. ..... 297/378.1
6,644,733 B1 * 11/2003 Tseng ..... 297/68

* cited by examiner

*Primary Examiner*—Peter R. Brown
(74) *Attorney, Agent, or Firm*—Shook, Hardy & Bacon L.L.P.

(57) ABSTRACT

The ottoman recliner chair includes a pair of opposed side panels, a seat coupled between the side panels, and a back pivotably coupled to the seat. The back is pivotable between a stowed, horizontal position and a generally vertical position. A footrest is coupled to the side panels and seat with a footrest linkage. The footrest is movable between a stowed and extended position wherein the ottoman recliner chair is movable between a stowed ottoman position with the back in the horizontal position and the footrest in stowed position, and a reclined position with the back in the generally vertical extended position and the footrest in extended position.

6 Claims, 3 Drawing Sheets

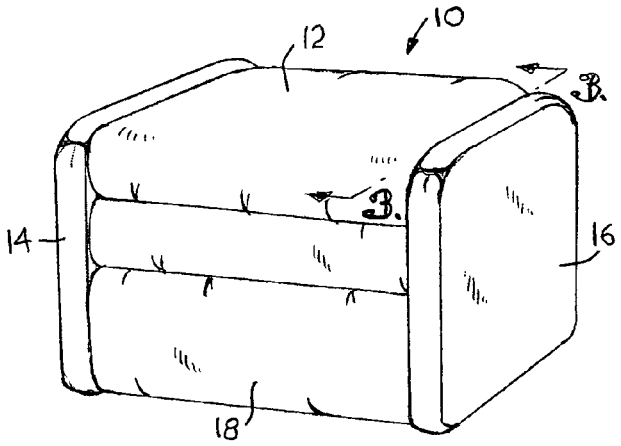
FIG. 1.
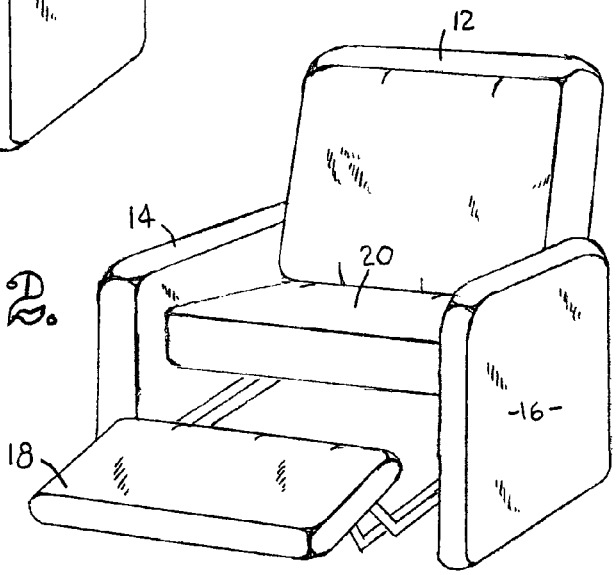
FIG. 2.
FIG. 3.
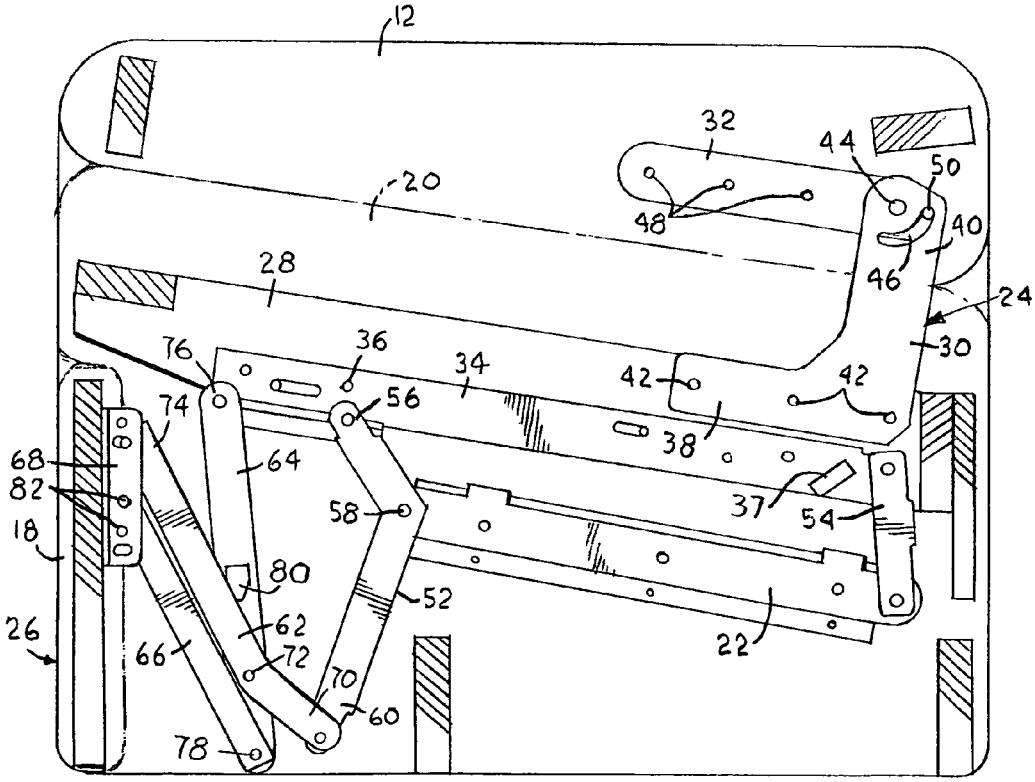

OTTOMAN RECLINER

CROSS-REFERENCE TO RELATED APPLICATIONS

This application claims the benefit under 35 U.S.C. §119 (e) of provisional application No. 60/490,817, filed Jul. 29, 2003, bearing the title Multipurpose Furniture Piece.

STATEMENT REGARDING FEDERALLY SPONSORED RESEARCH OR DEVELOPMENT

Not applicable.

BACKGROUND OF THE INVENTION

This invention relates to an ottoman recliner, and more particularly to an ottoman that may be converted to a recliner.

Typical ottomans are known in the furniture industry as a furniture item that is used as a footrest while sitting on a chair or sofa. The ottoman is thus used, typically, in combination with another furniture item. It is also the case, however, that ottomans may be used as a seat as well. In a crowded room, the ottoman may provide an "extra" seating option. While the ottoman may be so used, it does not offer the same comfort as other items of furniture, due to the lack of back support, or the ability to recline.

Recliners are also well known in the furniture industry. Typically, recliners are chairs with extendable footrests that allow the user to recline and may include a number of alternatives used in moving the chair between the reclining position and stowed position. Some chairs are reclined by the user leaning back in the chair, others may use a handle or lever, and still some others are motorized.

Thus, while conventional ottomans and recliners are known, there remains a need for an ottoman that offers additional comfort when used as a seat. More specifically, there is a need in the furniture industry for an ottoman that is easily converted between an ottoman and a recliner.

BRIEF SUMMARY OF THE INVENTION

Accordingly, the present invention provides an ottoman that may be easily converted to a recliner chair. The ottoman recliner chair of the present invention is movable between a stowed, ottoman position and a reclined, extended position. The ottoman recliner chair includes a pair of opposed side panels with a seat coupled between the side panels. A back is provided that is pivotable between a stowed, horizontal position and a generally vertical position. A footrest is coupled to the side panels and the seat with a footrest linkage.

To convert the ottoman recliner from the closed ottoman position to the open recliner position, the user initially rotates the top cushion of the ottoman rearwardly. The backrest of the recliner is actually the top cushion of the ottoman unit with an integral hinge linkage applied within the internal framing. Under the top cushion or backrest is the seat cushion. Once the backrest is in the upright position, a user may be seated and can recline the chair by pushing back on the backrest while grasping the side panels. The rearward force engages the recliner mechanism and causes it to move rearwardly. This rearward motion engages the footrest mechanism and moves it from the closed ottoman position to the open recliner position.

Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views:

FIG. 1 is a perspective view of an ottoman recliner in the closed ottoman position;

FIG. 2 is a perspective view of the ottoman recliner of FIG. 1 in the open recliner position;

FIG. 3 is cross sectional view of the ottoman recliner in the closed ottoman position taken along line 3-3 of FIG. 1;

DETAILED DESCRIPTION OF THE INVENTION

Figure 4:
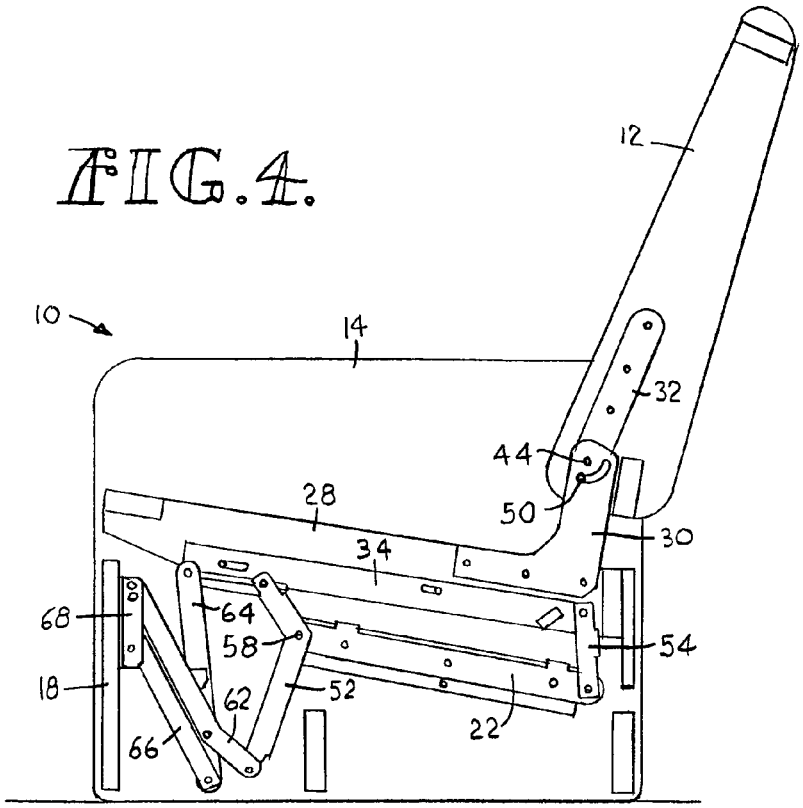
FIG. 4 is view of the ottoman recliner similar to FIG. 3, but with the chair in the chair position, and without the seat cushion for clarity.

Referring to the drawings in greater detail and initially to FIG. 1, an ottoman recliner is shown and designated generally by the numeral 10. Ottoman recliner 10 includes a top cushion 12, a pair of side panels 14, 16 and a front footrest portion 18. FIG. 1 illustrates the ottoman recliner 10 in the ottoman position. In this position, ottoman recliner 10 looks similar to existing ottomans. FIG. 2 illustrates ottoman recliner 10 in a recliner position with the top cushion 12 now functioning as a backrest, with the front footrest 18 in the extended position, and with a seat cushion 20, now exposed. As can be seen, the top cushion 12 serves both as a seat cushion and as a backrest depending on the position of ottoman 10. The front portion 18 serves as both a front panel and as a footrest depending of the position of ottoman 10. As best seen in FIG. 3, the top cushion 12 and seat 20 are angled so as to provide an ergonomically suitable unit that also folds as desired.

Figure 5:
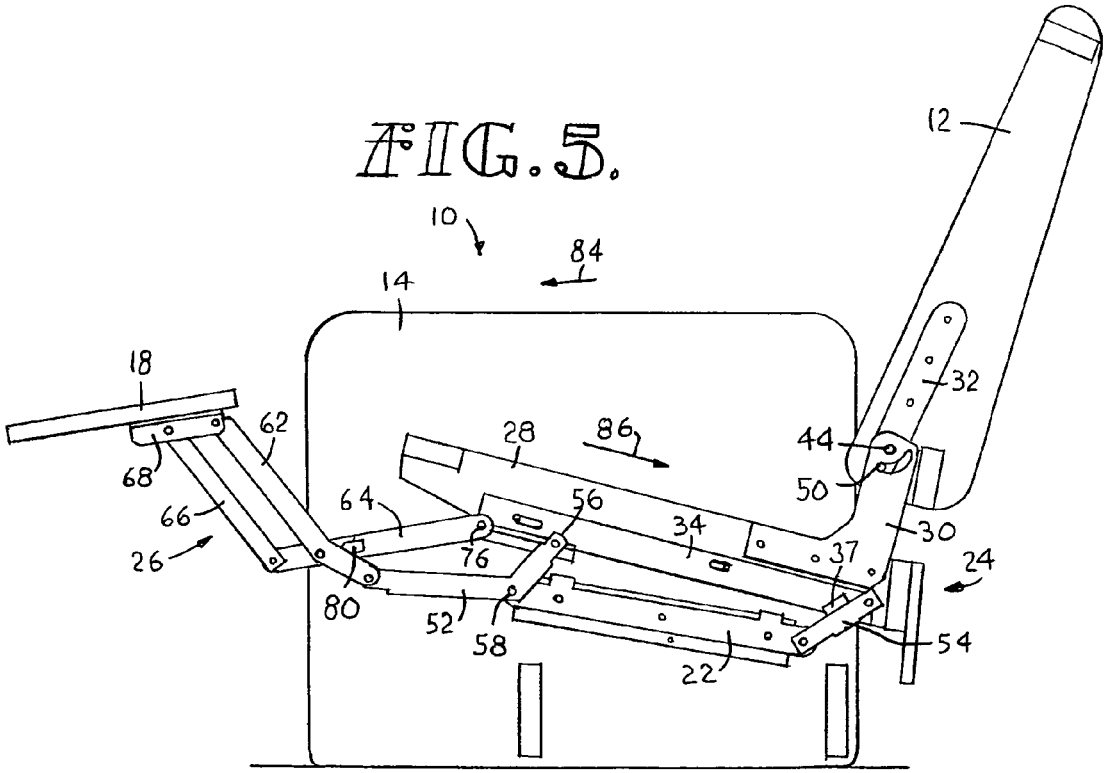
FIG. 5 is view of the ottoman recliner similar to FIG. 3, but with the chair in the open recliner position, and without the seat cushion for clarity.
Figure 6:
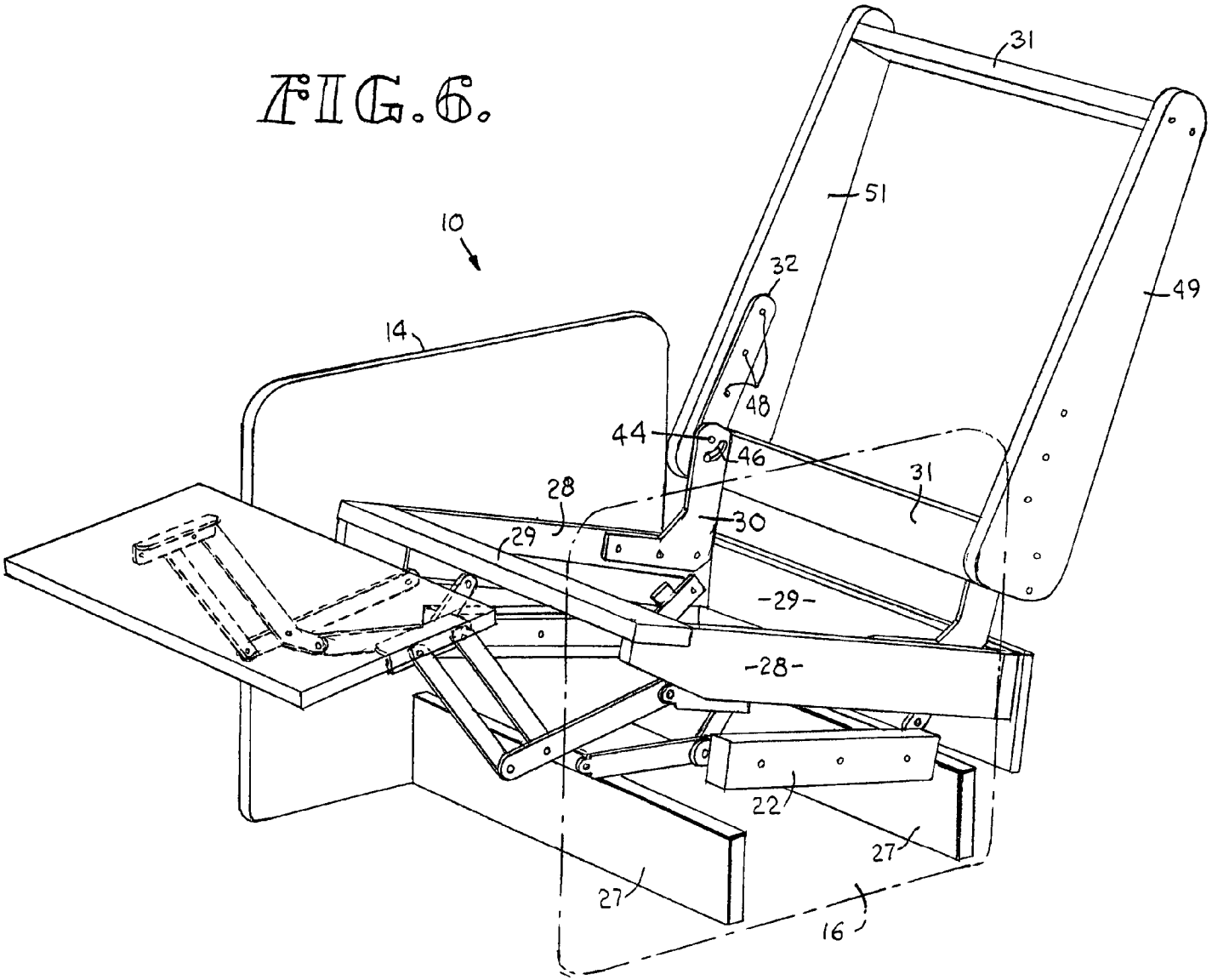
FIG. 6 is an isometric view of the ottoman recliner similar to FIG. 5 shown without the cushioning for clarity.

The internal linkages of ottoman 10 are best seen in FIGS. 3-5. As best seen in FIGS. 3-5 the ottoman recliner linkages broadly include a stationary bracket 22, a recliner mechanism 24, and a footrest mechanism 26. As best seen in FIG. 6, it will be appreciated that the above referenced items contain mirror-image replicas on each side of the ottoman recliner. As best illustrated in FIG. 6, ottoman recliner 10 broadly includes a plurality of cross-support members 27, 29, and 31. Base support members 27 are fixably coupled to side member 14 at one end and fixably coupled to side member 16 at the other end. Stationary bracket 22 is fixably coupled to side panel 16. Any suitable attachment mechanism could be used for coupling stationary bracket 22 to side panel 16, such as screws, bolts, pins or the like. Recliner mechanism 24 is rotatably coupled to stationary bracket 22. Footrest mechanism 26 is rotatably coupled to stationary bracket 22 and recliner mechanism 24. Thus stationary bracket 22 serves to interconnect recliner mechanism 24 to footrest mechanism 26, and is the point about which the linkages, described below, move.

With reference to FIGS. 3-6, recliner mechanism 24 broadly includes the seat 20, a seat support 28, support members 29, an L-shaped link 30, and a back link 32, which are further described below. Seat 20 is fixably coupled to seat support 28. Seat support 28 is located under seat 20 and provides support when the user is seated. While not shown, seat 20 may include additional support such as resilient foam, springs or the like, as would be understood by one skilled in the art. Seat support 28 is a generally elongated rectangular block member and can be made from any suitable material such as wood. Support members 29 are fixably coupled to seat supports 28 to provide additional support. Seat support 28 includes a mounting bracket 34 located on its lower portion. Mounting bracket 34 contains a plurality of apertures 36 used for attachment to support 28. Mounting bracket 34 further includes a stop 37. Stop 37 serves to cease rearward movement of recliner linkage 24, as will be discussed further below.

L-shaped link 30 includes a lower leg 38 and an upper leg 40. Lower leg 38 contains a number of apertures 42 used to fixably couple it to seat support 28 at its lower leg 38. Again, any suitable attachment mechanism could be used, such as screws, bolts, pins or the like. Upper leg 40 contains a mounting aperture 44 and an arcuate slot 46. It will be appreciated from FIGS. 3-5 that slot 46 serves to allow a controlled rotation of approximately ninety degrees. L-shaped link 30 is coupled to back link 32 at its upper leg 40 using aperture 44 and slot 46. Again, any suitable attachment mechanism could be used, such as screws, bolts, pins or the like. Back link 32 contains a plurality of apertures 48 and a protrusion 50. Protrusion 50 is generally cylindrical in nature and extends outwardly from back link 32. Protrusion 50 is received in slot 46 contained in L-shaped link 30. Link 32 is also pivotably coupled to link 30 about the connection point 44. As best seen in FIG. 6, back link 32 is fixably coupled to internal framework 49, 51 of backrest 12, using aperture 44 and apertures 48. Back support members 31 are coupled to internal framework 49, 51 to provide additional support. As can best be seen by comparing FIGS. 3 and 4, when the front of backrest 12 is moved upwardly, the backrest rotates about mounting aperture 44 through a defined angle of approximately ninety degrees, defined by arcuate slot 46.

Recliner mechanism 24 is coupled to stationary bracket 22 through bracket 34 and an activator link 52 and a connector link 54. Thus, activator link 52 and connector link 54 attach recliner mechanism 24 to stationary bracket 22. Again, any suitable attachment mechanism could be used, such as screws, bolts, pins or the like.

Activator link 52 is generally L-shaped and includes an attaching end 56, a link pivot 58, and a drive end 60. Activator link 52 is rotatably coupled to mounting bracket 34 on recliner mechanism 24 at attaching end 56. Attaching end 56 has a hole therethrough, which facilitates fastening activator link 52 to mounting bracket 34. Activator link 52 is also rotatably coupled to stationary bracket 22 at link pivot 58.

Connector link 54 is rotatably coupled to mounting bracket 34 on recliner mechanism 24 on its upper end and to stationary bracket 22 on its lower end. Connector link 54 has holes located at its ends for facilitating attachment to mounting bracket 34 and stationary bracket 22.

With continued reference to FIGS. 3-5, the footrest mechanism 26 will be described in more detail. Footrest mechanism 26 includes a drive link 62, a straight link 64, an up link 66, a bracket 68, and footrest 18. Drive link 62 is generally L-shaped and includes a drive end 70, a pivot 72, and an upper end 74. As best seen in FIG. 3 drive link 62 is rotatably coupled to activator link 52 at drive end 70 and is coupled to bracket 68 at upper end 74. Straight link 64 includes an upper end 76, a pivot point 72, a lower end 78, and a stop 80. Straight link 64 is rotatably coupled to mounting bracket 34 at upper end 76 and rotatably coupled to up link 66 at lower end 78. Straight link 64 is pivotably coupled to drive link 62 at pivot 72 and thus forms a scissor linkage with drive link 62. Stop 80 on link 64 serves to cease rotation of footrest mechanism 26. Opposite the connection of up link 66 to straight link 64, up link 66 is coupled to bracket 68. Bracket 68 is generally rectangular and contains a plurality of apertures 82 for fastening the various links to footrest 18. Bracket 68 is fixably coupled to footrest 18.

The conversion of the ottoman to the recliner 10 is best described with reference to FIGS. 3-5. FIG. 3 represents the ottoman recliner 10 in the closed ottoman position, position one. FIG. 4 represents the ottoman recliner 10 in the open chair position, position two. FIG. 5 represents the ottoman recliner 10 in the open recliner position, position three. In use, if the occupant desires to convert from position one to position two, the user rotates the top cushion 12 rearwardly. The seat 20 is located under the top cushion/backrest 12. The top cushion 12 rotates about mounting aperture 44. The amount of rearward rotation is limited by the slot 46 and protrusion 50 configuration. It will be appreciated from FIGS. 3-5 that the amount of rotation is limited to approximately ninety degrees. As the top cushion 12 begins to pivot rearwardly about the mounting aperture 44, the relative positions of the seat 20 and footrest 18 remain fixed. When the top cushion 12 reaches its rotational limit, as defined by slot 46 and protrusion 50, the ottoman recliner is in position two as illustrated in FIG. 4.

To move from position two to position three, additional force is applied to side panels 14, 16. The forward force in direction 84 on the side panels 14, 16, shown in FIG. 5, causes the seat portion 20 to move rearwardly as shown by reference numeral 86. As the seat 20 begins to move rearwardly, the recliner mechanism 24 rotates clockwise about the stationary bracket 22. This clockwise movement causes interconnected links 54, 52, and 64 to rotate clockwise about the stationary bracket 22. The clockwise motion engages acitvator link 52 and straight link 64. Consequently, the activator link 52 pivots clockwise about pivots 56, 58 and straight link 64 pivots clockwise about pivot 76. This action in turn causes links 52 and 64 to push upwardly on links 62, 66 thereby beginning the extension of the footrest 26 from its tucked position underneath the seat 20. Continued rearward motion of the recliner mechanism 24 causes links 62, 66 to move upwardly. Rearward motion ceases when the connector link 54 and drive link 62 contact stops 37 and 80 respectively which serve to lock the footrest 18 in its fully extended position, position three, as shown in FIG. 5. Footrest mechanism 26 is closed in the conventional method by applying a downward force.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An ottoman recliner chair, comprising:

a pair of opposed side panels;

a seat coupled between the side panels;

a back pivotably coupled to the seat, the back pivotable between a stowed, horizontal position and a generally vertical position;

a recliner mechanism coupled to the back and seat, the recliner mechanism allowing and controlling the pivotal connection between the seat and the back, wherein the recliner mechanism includes a seat support fixably coupled to the seat, a back link fixably coupled to the back, and an L-shaped link fixably coupled to the seat support and pivotably coupled to the back link, wherein the seat support includes a mounting bracket located on a lower portion thereof, and wherein the L-shaped link contains a pivot and a slot on its upper end, the pivot allowing for pivotal movement of the back, and further wherein the slot receives a protrusion that extends outwardly from the back link, thereby controlling the rotational limit of the back;

a stationary bracket fixably coupled to a side rail, wherein the recliner mechanism is rotatably coupled to one end of the stationary bracket by a connector link, the connector link being rotatably coupled to the mounting bracket on the connector link's upper end and to the stationary bracket on the connector link's lower end;

a footrest coupled to the side panels and the seat by a footrest mechanism, the footrest being movable between a stowed and extended position in response to a forward force applied to the side panels by a seated user;

wherein the ottoman recliner chair is movable between a stowed position where the ottoman recliner may be used as an ottoman with the back in the horizontal position and the footrest in stowed position, and a reclined position where the ottoman recliner may be used as a recliner with the back in the generally vertical extended position and the footrest in extended position wherein the mounting bracket includes a stop that ceases rearward movement of the recliner mechanism when the connector link contacts the stop, thereby locking the footrest in a fully extended position.

2. The ottoman recliner chair of claim 1, wherein the back link rotates about the pivot to rotate back from a stowed, horizontal position to a generally vertical extended position.

3. A multi-use furniture item comprising:

a pair of opposed side panels, each of said side rails having a stationary bracket fixably coupled to an inside surface thereof;

a seat coupled between the side panels;

a seat support fixably coupled to the bottom of the seat, wherein the seat support includes a mounting bracket coupled on a lower portion of the seat support;

a top surface pivotably coupled to the seat, the top surface pivotable between a stowed horizontal position and a generally vertical extended position;

a footrest rotatably coupled to the stationary bracket and to the seat with a footrest mechanism, the footrest movable between a stowed and extended position; and a recliner mechanism coupled to the stationary bracket via the mounting bracket and a connector link, wherein the connector link is rotatably coupled, at an upper end, to the mounting bracket and rotatably coupled, at a lower end, to the stationary bracket, the recliner mechanism allowing and controlling the pivotal connection between the seat and the top surface, wherein the recliner mechanism includes, a top surface link fixably coupled to the top surface, and an L-shaped link fixably coupled to the seat support and pivotably coupled to the top surface link, wherein the L-shaped link contains a pivot and a slot on its upper end, the pivot allowing for pivotal movement of the top surface, and further wherein the slot receives a protrusion that extends outwardly from the top surface link, thereby controlling the rotational limit of the top surface;

wherein the multi-use furniture item is movable between a stowed position where the multi-use furniture item may be used as an ottoman with the top surface in the horizontal position and the footrest in stowed position, and a reclined position where the multi-use furniture item may be used as a recliner with the top surface in the generally vertical extended position and the footrest in extended position, wherein the mounting bracket includes a stop that ceases rearward movement of the recliner mechanism when the connector link contacts the stop, thereby locking the footrest in a fully extended position.

4. The multi-use furniture item of claim 3, wherein the top surface link rotates about the pivot to move the top surface from a stowed, horizontal position to a generally vertical extended position.

5. A furniture piece convertible from an ottoman to a recliner comprising:

a pair of opposed side panels;

a stationary bracket fixably coupled to each of the pair of side panels;

a seat coupled between the side panels;

a seat support fixably coupled to the seat;

a back pivotably coupled to the seat, the back pivotable between a stowed, horizontal position and a generally vertical position;

a footrest coupled to the side panels and seat; and a recliner means coupled to the seat and to each of the pair of side panels by a connector link that is rotatably coupled, at an upper end, to a mounting bracket located on a lower portion of the seat support and rotatably coupled, at a lower end, to the stationary bracket, the recliner means being adapted to move the furniture piece between a stowed position where the furniture piece may be used as an ottoman with the back in the horizontal position and the footrest in the vertical stowed position, and an open position where the furniture piece may be used as a recliner with the back in the generally vertical position and the footrest in the generally horizontal position, wherein the mounting bracket includes a stop that ceases rearward movement of the recliner mechanism when the connector link contacts the stop, thereby locking the footrest in a fully extended position;

wherein the recliner means includes a seat support fixably coupled to the seat, a back link fixably coupled to the back, and an L-shaped link fixably coupled to the seat support and pivotably coupled to the back link, wherein the L-shaped link contains a pivot and a slot on its upper end, the pivot allowing for pivotal movement of the back, and further wherein the slot receives a protrusion that extends outwardly from the back link, thereby controlling the rotational limit of the back.

6. The furniture piece of claim 5, wherein the back link rotates about the pivot to rotate back from a stowed, horizontal position to a generally vertical extended position.

* * * * *